US008100036B2

(12) United States Patent
Huang

(10) Patent No.: US 8,100,036 B2
(45) Date of Patent: Jan. 24, 2012

(54) RATCHET WRENCH

(76) Inventor: Ping-Chung Huang, Taichung County (TW)

( * ) Notice: Subject to any disclaimer, the term of this patent is extended or adjusted under 35 U.S.C. 154(b) by 26 days.

(21) Appl. No.: 12/706,948

(22) Filed: Feb. 17, 2010

(65) Prior Publication Data

US 2011/0197717 A1 Aug. 18, 2011

(51) Int. Cl.
*B25B 13/46* (2006.01)

(52) U.S. Cl. ..... 81/58.2; 81/60

(58) Field of Classification Search ..... 81/58.2, 81/61, 111, 99
See application file for complete search history.

(56) References Cited

U.S. PATENT DOCUMENTS 2,527,033 A * 10/1950 Rodgers et al. ..... 81/58.2
2,757,564 A * 8/1956 Reaves ..... 81/58.2
4,441,387 A * 4/1984 Hendricks ..... 81/61
4,631,990 A * 12/1986 Hughes ..... 81/58.2
4,718,315 A * 1/1988 Nitschmann ..... 81/58.2

* cited by examiner

*Primary Examiner* — Hadi Shakeri
(74) *Attorney, Agent, or Firm* — Rosenberg, Klein & Lee

(57) ABSTRACT

A ratchet wrench includes a handle and a moving jaw. The handle has a pivot portion disposed at a working end of the handle and a fixed jaw integrally extended from the handle. The moving jaw has a pivoting base pivotally coupled to the pivot portion, and a ratchet is installed between the two jaws, and the moving jaw further has a clamp, and the clamp has a plurality of continuously arranged teeth, and the handle has an elastic element for propping the moving jaw, such that the moving jaw can be abutted against the ratchet, and the teeth of the moving jaw are engaged with the teeth of the ratchet.

6 Claims, 8 Drawing Sheets

RATCHET WRENCH

BACKGROUND OF THE INVENTION

1. Field of the Invention

The present invention relates to a ratchet wrench, and more particularly to a ratchet wrench having a structure of simple components and featuring a convenient application.

2. Description of the Related Art

With reference to FIG. 7 for a conventional closed ratchet wrench, the wrench includes a closed ratchet 61 having a hole 62 for sheathing a screw element such as a bolt or a nut, a latch element 64 installed in a slot 63 of the wrench and engaged with the ratchet 61, an elastic element 65 for supporting and propping the latch element 64 to control the ratchet 61 to be rotated in a direction repeatedly.

With reference to FIG. 8 for another conventional opening ratchet wrench, the wrench includes a C-shaped jaw 71, a non-closed ratchet 72 contained in the jaw 71, and a latch element 73 included between the jaw 71 and the ratchet 72 and an elastic element 74, wherein the latch element 73 is propped and pushed by the elastic element 74 to control the ratchet 72 to turn in a direction repeatedly.

Although the closed ratchet wrench can use the ratchet 61 with more teeth around its external circumference to rotate with a smaller angle reciprocally, users have to sheathe the ratchet 61 vertically around the external periphery of a workpiece, but cannot sheathe the ratchet 61 sideway to the external periphery of the workpiece, so that such ratchet wrench cannot be operated in a special space such as a nut installed onto a pipeline, and thus giving rise to an inconvenient operation.

As to the opening ratchet wrench, users can sheathe the ratchet 61 sideway to the external periphery of the workpiece, but both of the conventional ratchet wrenches come with a complicated structure and require additional components such as the latch elements 64, 73 for controlling and driving the ratchet as well as a more complicated manufacturing process.

In view of the foregoing shortcomings of the prior art, the inventor of the present invention based on years of experience in the related industry to conduct extensive researches and experiments, and finally developed a ratchet wrench in accordance with the present invention.

SUMMARY OF THE INVENTION

In view of the shortcomings of the prior art, the inventor of the present invention based on years of experience in the related industry to conduct extensive researches and experiments, and finally developed a ratchet wrench in accordance with the present invention to Therefore, it is a primary objective of the present invention to overcome the aforementioned shortcoming and deficiency of the prior art by providing a ratchet wrench composed of a fixed jaw, a moving jaw, a ratchet and an elastic element, and having a structure much simpler than the conventional ratchet wrenches, and the simple structure comes with less components and allows users to operate the ratchet wrench in a special space, such as a pipeline.

A secondary objective of the present invention is to install a ratchet between a moving jaw and a fixed jaw, wherein the moving jaw has a clamp for latching teeth of the ratchet, and an elastic element is provided for supporting and propping the moving jaw, such that the ratchet can be rotated in a direction with respect to the handle and the jaw, and the wrench can achieve the effects of an idle rotation and a reciprocal operation.

A tertiary objective of the present invention is to design the radius of curvature of the external circumference of the ratchet to be smaller than the radius of curvature of the clamp of the moving jaw in order to engage the teeth of the ratchet with the teeth of the moving jaw, and the tooth pitch of the ratchet to be smaller than the tooth pitch of the moving jaw in order to enhance the strength of the teeth of the moving jaw. In addition, the elastic element is provided for pressing the teeth of the moving jaw against the teeth of the ratchet, such that the ratchet can be rotated in a direction with respect to the handle and the two jaws.

A quaternary objective of the present invention is to provide a larger angle for pivotally turning the moving jaw, such that a larger opening can be provided between the moving jaw and the fixed jaw to facilitate the removal, replacement or maintenance of the ratchet between the two jaws.

To achieve the foregoing objective, the present invention provides a ratchet wrench, comprising:

a rod-shape handle, with a working end having a pivot portion, and a fixed jaw integrally extended from the working end, and the fixed jaw having a front end;

a moving jaw, having a pivoting base pivotally coupled to the pivot portion of the handle by a pivot element, and a clamp with an arc shape between both ends of the clamp and disposed at a position away from a moving end of the pivoting base, and the clamp having a plurality of continuously arranged teeth formed from the moving end, and an opening having a predetermined width and being formed between the front end of the fixed jaw and the moving end of the moving jaw moving end; and a ratchet, installed between the two jaws, and having a working hole formed at the center of the ratchet, a plurality of concave portions formed on a hole wall of the working hole, a plurality of teeth continuously arranged along a circumferential surface and disposed at an external circumference of the ratchet, an opening formed on a side of the ratchet and coupled to an opening between the front end of the fixed jaw and the moving end of the moving jaw, and the total length of plurality of teeth of the moving jaw being greater than the width of the opening of the ratchet;

an elastic element, installed onto the handle, for supporting and propping the moving jaw, such that the moving jaw can exert a compression force against the ratchet, and the teeth of the moving jaw can be engaged with the teeth of the ratchet.

The foregoing and other objectives and advantages of the present invention will become apparent with the detailed description of the preferred embodiments and the illustration of the related drawings.

Of course, other elements or arrangements of other elements of the present invention may vary, but the selected preferred embodiments are described in details in this specification and illustrated by the drawings as follows.

DETAILED DESCRIPTION OF THE PREFERRED EMBODIMENTS

Figure 1:
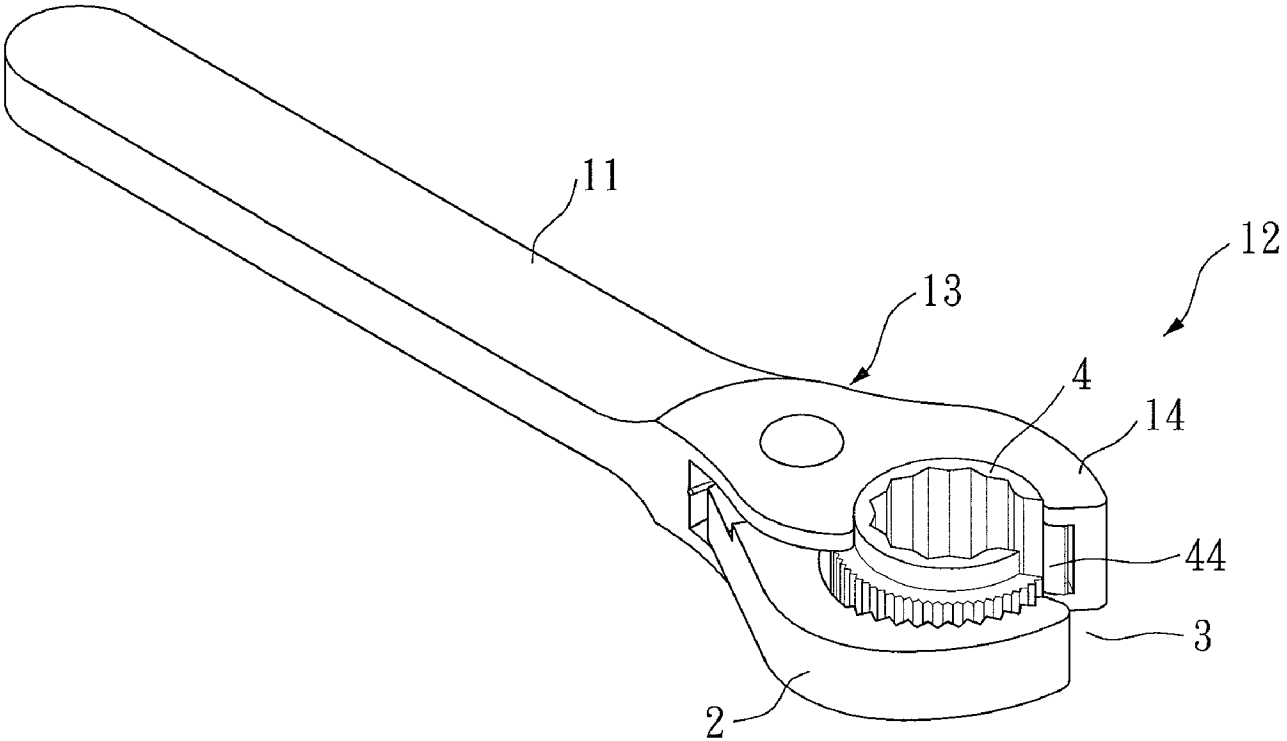
FIG. 1 is a perspective view of the present invention.
Figure 2:
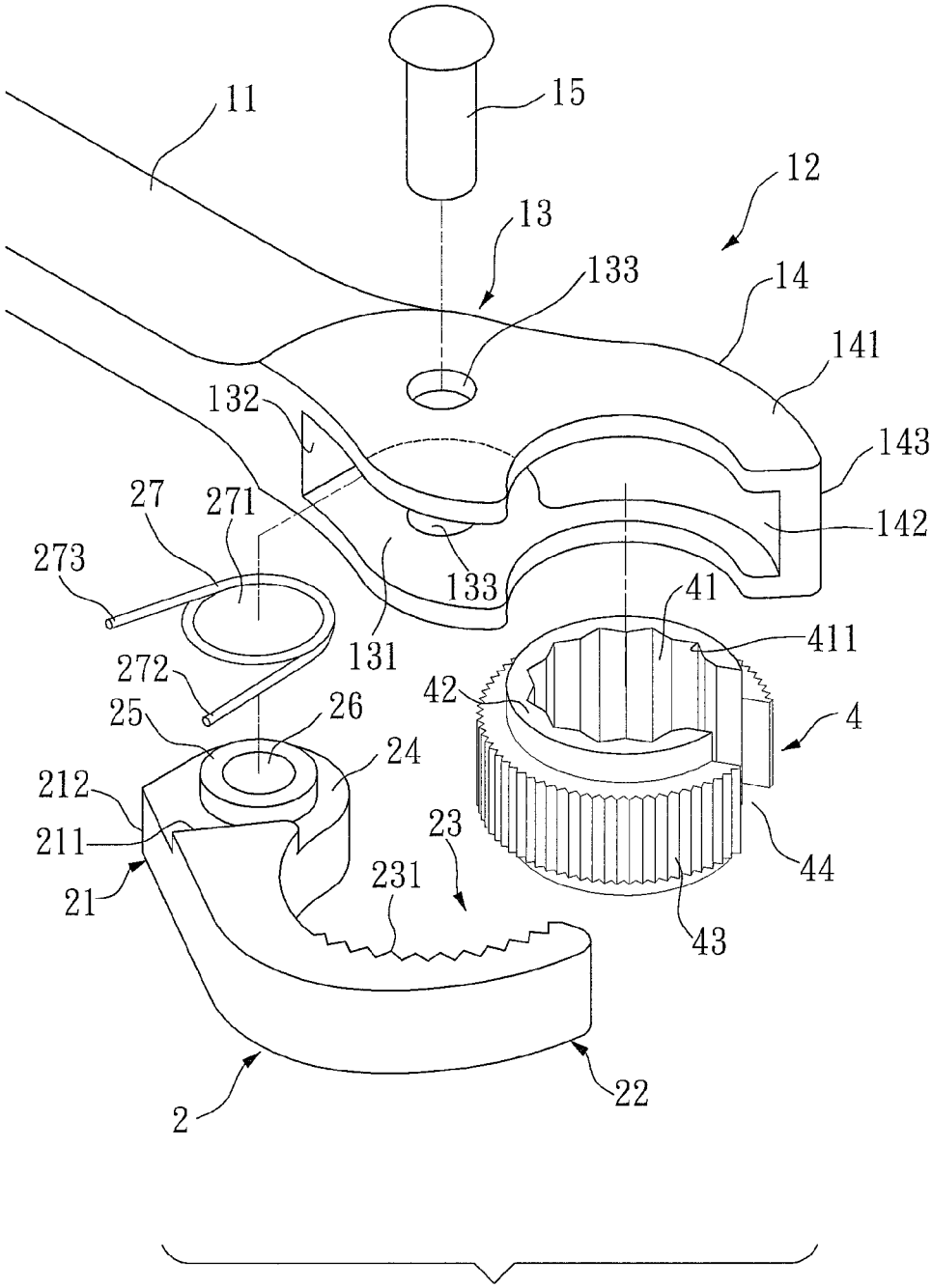
FIG. 2 is an exploded view of the present invention.

The technical characteristics of the present invention will become apparent with the detailed description of the preferred embodiments and the illustration of the related drawings.

With reference to FIGS. 1 to 6 for preferred embodiments of a ratchet wrench in accordance with the present invention, the preferred embodiments are provided for the purpose of demonstrating the present invention only, but not intended for limiting the scope of the invention.

The ratchet wrench in accordance with a first preferred embodiment of the present invention comprises:

a handle 11, having a working end 12, a pivot portion 13 formed at the working end 12 and a fixed jaw 14 in an arc shape and integrally extended from the working end 12, wherein the pivot portion 13 has a containing space 131 formed at an internal side of the pivot portion 13, and the containing space 131 has a bottom edge 132, and the pivot portion 13 has two axle holes 133 formed on both lateral sides of the containing space 131 respectively, and a stop wall 141 is formed separately on both lateral surfaces of the fixed jaw 14, and each of the two stop walls 141 has an arc-shaped groove 142 formed on an internal side of the stop wall 141, and a front end 143 of the fixed jaw 141 is defined, and the groove 142 is extended from the front end 143 to the pivot portion 13;

a moving jaw 2, having a pivoting base 21 pivotally coupled to the pivot portion 13 of the handle 11, and a moving end 22 disposed at a position away from the pivoting base 21, wherein an arc-shaped clamp 23 is installed between both ends, and the clamp 23 includes a plurality of continuously arranged teeth 231 starting from the moving end 22, such that the pivoting base 21 can be installed in the containing space 131 of the pivot portion 13, and the pivoting base 21 has a recession 24, a stop edge 211 formed on a side of the recession 24 of the pivoting base 21, and a protrusion 212 blocked by the bottom edge 132 in the containing space 131 of the handle 11, and the recession 24 has a protruding base 25, and a through hole 26 is formed at the center of the protruding base 25 and corresponding to the axle hole 133 of the pivot portion 13, such that the through hole 26 and two axle holes 133 are aligned with each other, and a pivot element 15 is provided for a pivotal connection, and the moving jaw 2 can be rotated pivotally with respect to the fixed jaw 14, and the protrusion 212 is abutted against the bottom edge 132 of the containing space 131, and an opening 3 with a predetermined width is formed between the moving end 22 of the moving jaw 2 and the front end 143 of the fixed jaw 14;

a ratchet 4, rotably installed between the fixed jaw 14 and the moving jaw 2, and having a working hole 41 formed at the center of the ratchet 4 for latching a screw element, and a plurality of concave portions 411 formed at a hole wall of the working hole 41, wherein a stop ring 42 and a plurality of teeth continuously arranged along a circumferential surface 43 are disposed at the external circumference of the ratchet 4, such that the stop ring 42 can be mounted onto the stop wall 141, and the teeth 43 at the circumferential surface of the ratchet 4 can be installed in the groove 142, and the radius of curvature of the external circumference of the ratchet 4 is smaller than the radius of curvature of the clamp 23 of the moving jaw 2, and the tooth pitch of the plurality of teeth 43 at the external circumference of the ratchet 4 is smaller than the tooth pitch of the plurality of teeth 231 of the moving jaw 2, and the ratchet 4 in this preferred embodiment includes an opening 44 coupled to an opening 3 between the front end 143 of the fixed jaw 14 and the moving end 22 of the moving jaw 2, and the total length of the plurality of teeth 231 of the moving jaw 2 is greater than the width of the opening 44 of the ratchet 4;

an elastic element 27, being a torque spring in this preferred embodiment, and installed onto the handle 11, and the elastic element 27 having a sheath hole 271 sheathed onto the protruding base 25, and both ends of the elastic element 27 being first and second abutting ends 272, 273, such that the first abutting end 272 abuts against the stop edge 211 of the recession 24 of the moving jaw 2, and the second abutting end 273 abuts against the bottom edge 132 of the containing space 131 of the handle 11, such that when the elastic element 27 drives the moving jaw 2 to exert a pressing force to the ratchet 4 to engage the teeth 231 of the moving jaw 2 with the teeth 43 of the ratchet 4, the distance D1 of the opening 3 between the moving end 22 of the moving jaw 2 and the front end 143 of the fixed jaw 14 is smaller than the external diameter D2 of the stop ring 42 of the ratchet 4.

Figure 3:
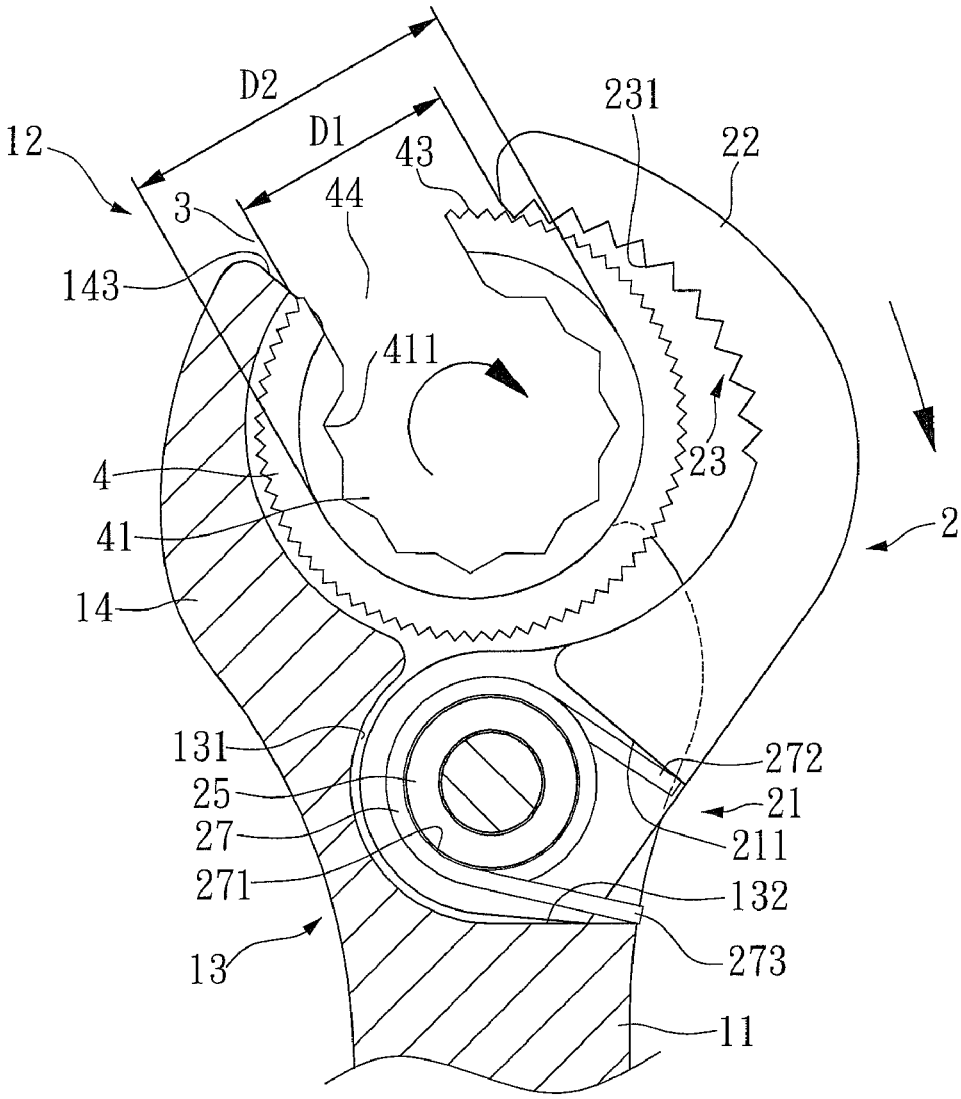
FIG. 3 is a schematic view of a ratchet wrench being turned clockwise in accordance with of the present invention.
Figure 4:
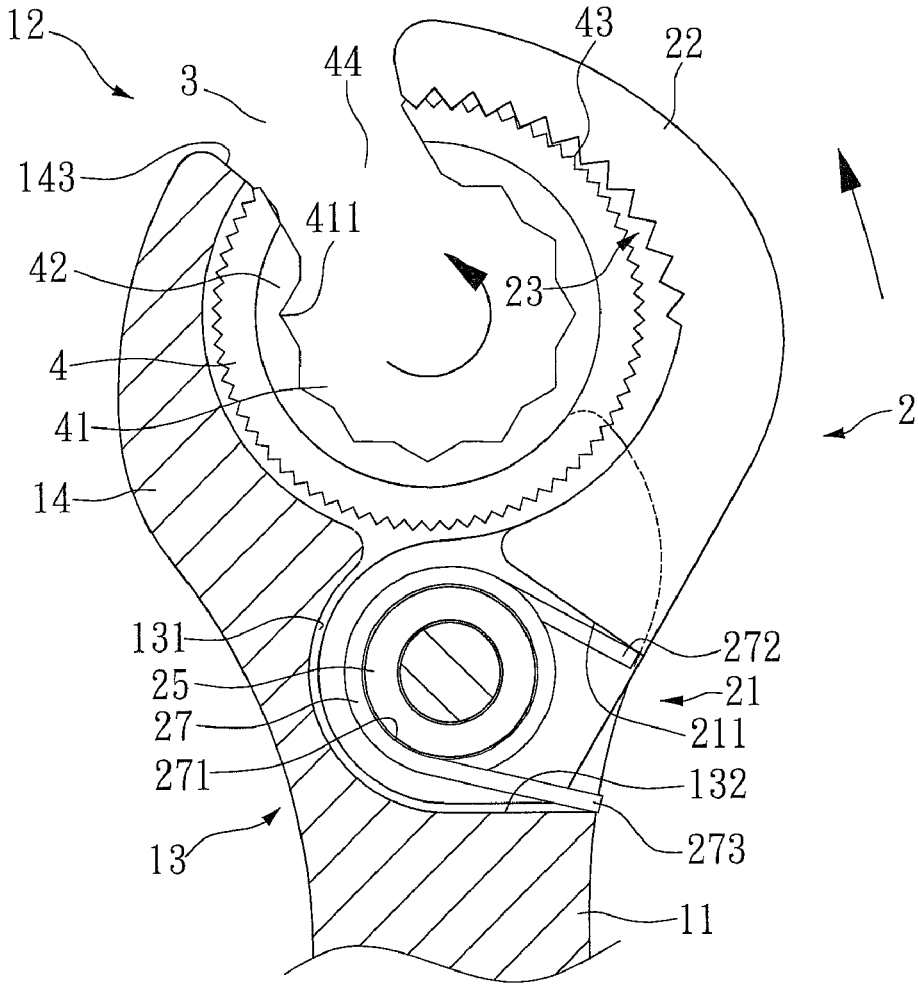
FIG. 4 is a schematic view of a ratchet wrench being turned counterclockwise in accordance with of the present invention.

With reference to FIG. 3, when the ratchet wrench is rotated clockwise, the teeth 43 of the ratchet 4 and the teeth 231 of the moving jaw 2 are engaged partially since the radius of curvature of the external circumference of the ratchet 4 is smaller than the radius of curvature of the clamp 23 of the moving jaw 2, and the strength of the teeth 231 of the moving jaw 2 can be enhanced since the tooth pitch of the teeth 43 of the ratchet 4 is smaller than the tooth pitch of the teeth 231 of the moving jaw 2. In addition, the elastic element 27 is provided for abutting the teeth 231 of the moving jaw 2 against the teeth 43 of ratchet 4. In the meantime, the moving jaw 2 is pivotally turned outward to a predetermined angle with respect to the fixed jaw 14, such that some of the teeth 231 are abutted and latched by the teeth 43 and cannot be rotated anymore. As a result, the ratchet wrench can turn a screw element. On the other hand, when the ratchet wrench is rotated counterclockwise as shown in FIG. 4, each of the engaged teeth 231 and teeth 43 can be separated easily since the radius of curvature of the external circumference of the ratchet 4 is smaller than the radius of curvature of the clamp 23 of the moving jaw 2, and the ratchet 4 can be rotated in a direction with respect to the handle 11 and the two jaws, and thus the ratchet wrench is no longer latched anymore, but it is situated in an idle rotation condition.

Figure 5:
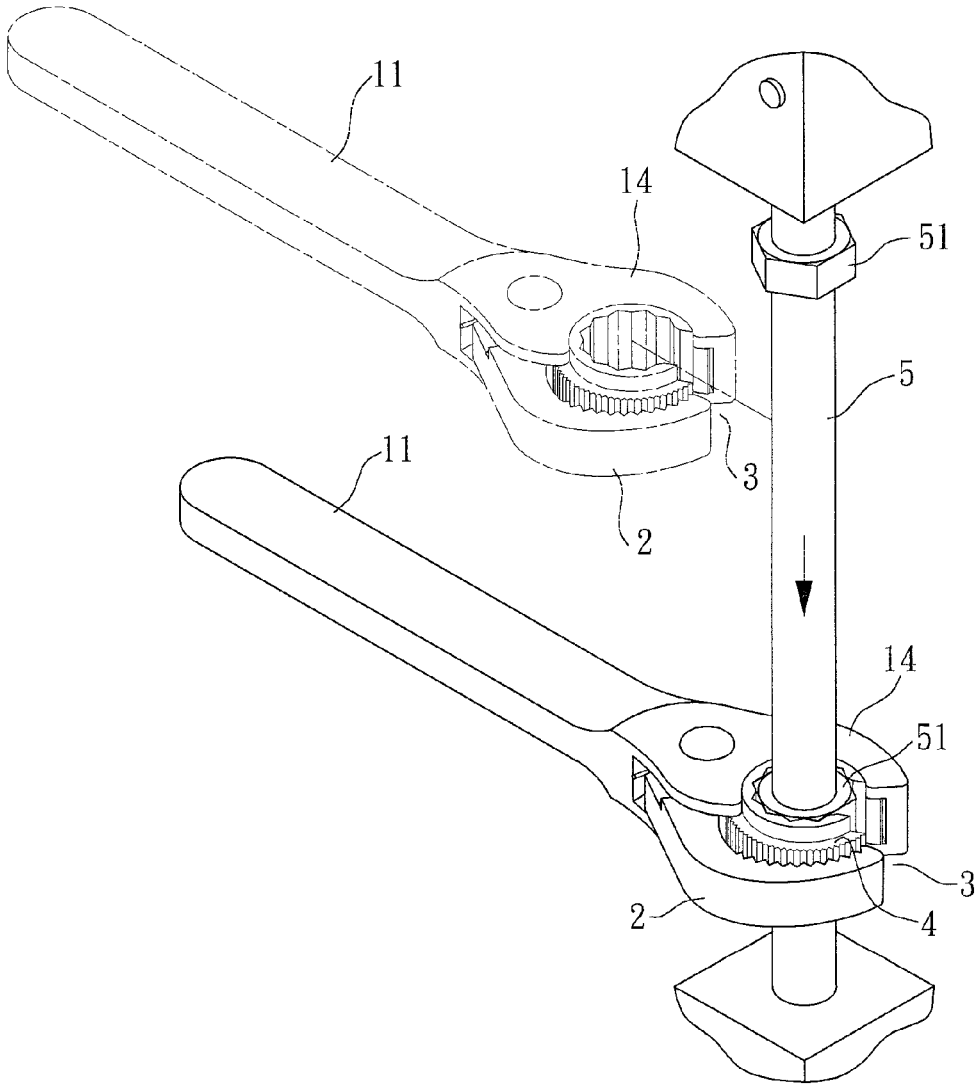
FIG. 5 is a schematic view of an application of the present invention.

With reference to FIG. 5 for an application of the present invention, the ratchet wrench of the present invention is used for turning a screw element 51 in a space of a pipeline 5 by sheathing the pipeline 5 into the opening 3 of the ratchet wrench and the opening 44 of the ratchet 4. After the working hole 41 is sheathed along the pipeline 5 to hold he screw element 51, the ratchet wrench can be operated. The ratchet wrench can achieve an idle rotation effect for a reciprocal operation, so that a user can operate the ratchet wrench in a small operating space. After the operation is completed, the opening 44 of the ratchet 4 can be aligned with the opening 3, so that the ratchet wrench can be separated from the screw element 51 quickly and conveniently.

After the pivoting base 21 of the moving jaw 2 is pivotally turned to a predetermined angle, the protrusion 212 on a side of the pivoting base 21 will be abutted against the bottom edge 132 of the containing space 131 of the 11, such that the pivoting base 21 cannot be turned pivotally anymore, but the pivoting base 21 will be limited within an interval between the moving end 22 of the moving jaw 2 and the front end 143 of the fixed jaw 14 to prevent the ratchet 4 from being separated from the two jaws.

Since the total length of the plurality of teeth 231 of the moving jaw 2 is greater than the width of the opening 44 of the ratchet 4, and the radius of curvature of the external circumference of the ratchet 4 is smaller than the radius of curvature of the clamp 23 of the moving jaw 2, therefore the teeth 43 of the ratchet 4 and the teeth 231 of the moving jaw 2 are engaged partially, and the ratchet 4 can be rotated in a direction successfully.

In addition, the distance of the moving jaw 2 from the center point of the pivot element 15 to the moving end 22 is greater than the distance of the fixed jaw 14 from the center point of the pivot element 15 to the front end 143. In other words, the opening 3 formed with respect to the two jaws is biased to a side of the fixed jaw 14 for facilitating the ratchet wrench to sheath the pipeline 5 and providing an easy grip to apply forces, and such arrangement also increases the contact area between the teeth 231 of the clamp 23 of the moving jaw 2 and the teeth 43 of the ratchet 4 to enhance the effect of clamping and latching the teeth 231 of the clamp 23 to the ratchet 4.

Figure 6:
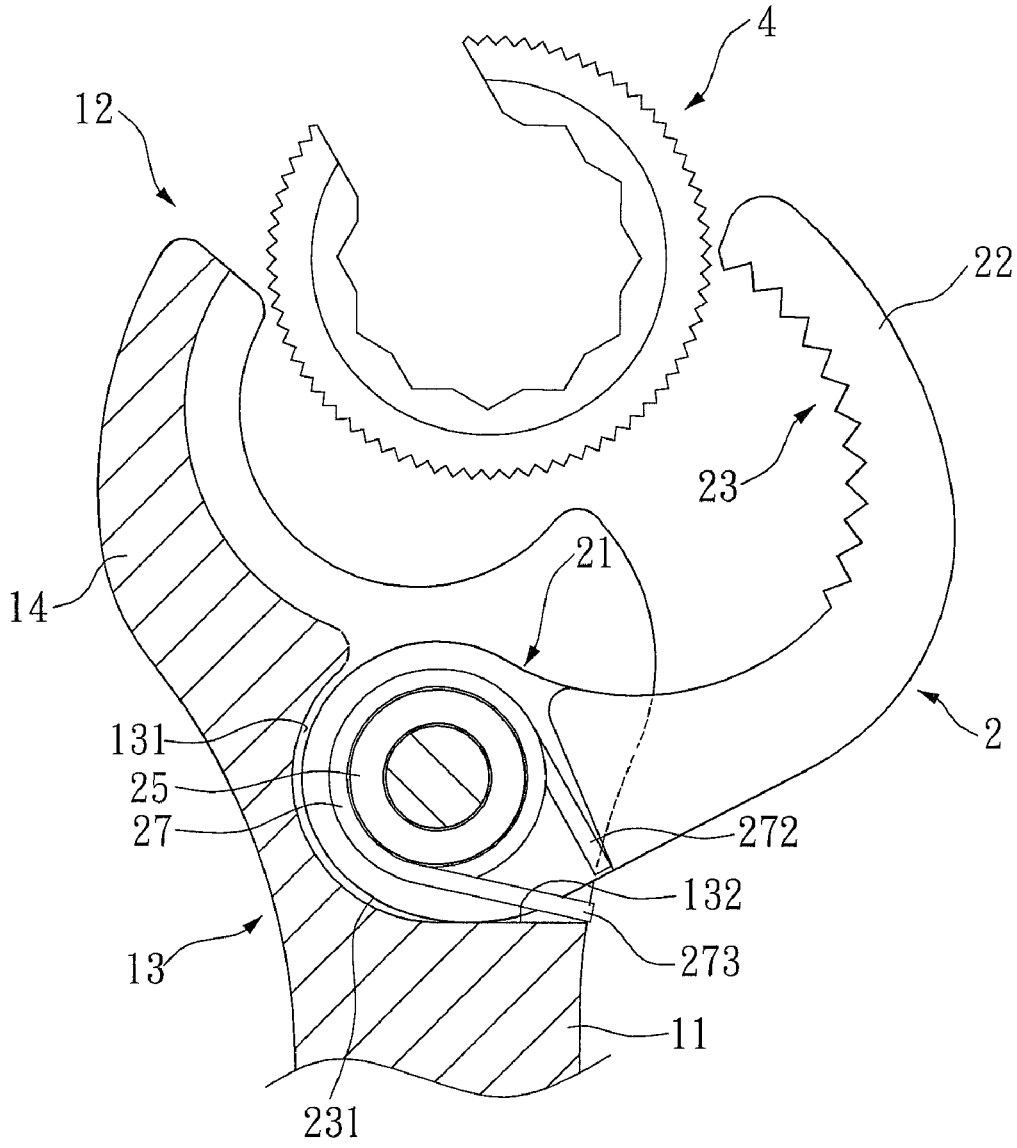
FIG. 6 is a schematic view of turning open a moving jaw of a ratchet wrench to remove a ratchet in accordance with a second preferred embodiment of the present invention.
Figure 7:
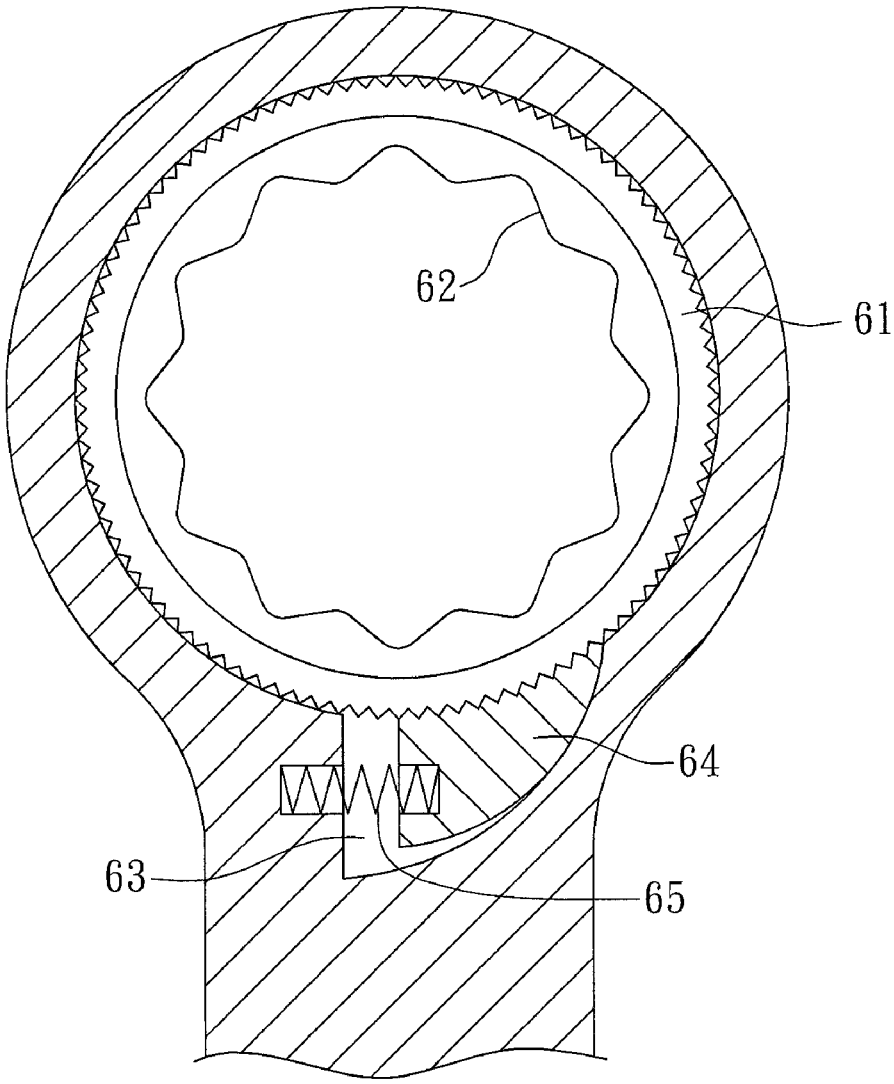
FIG. 7 PRIOR ART
FIG. 7 is a cross-sectional view of a conventional ratchet wrench.
Figure 8:
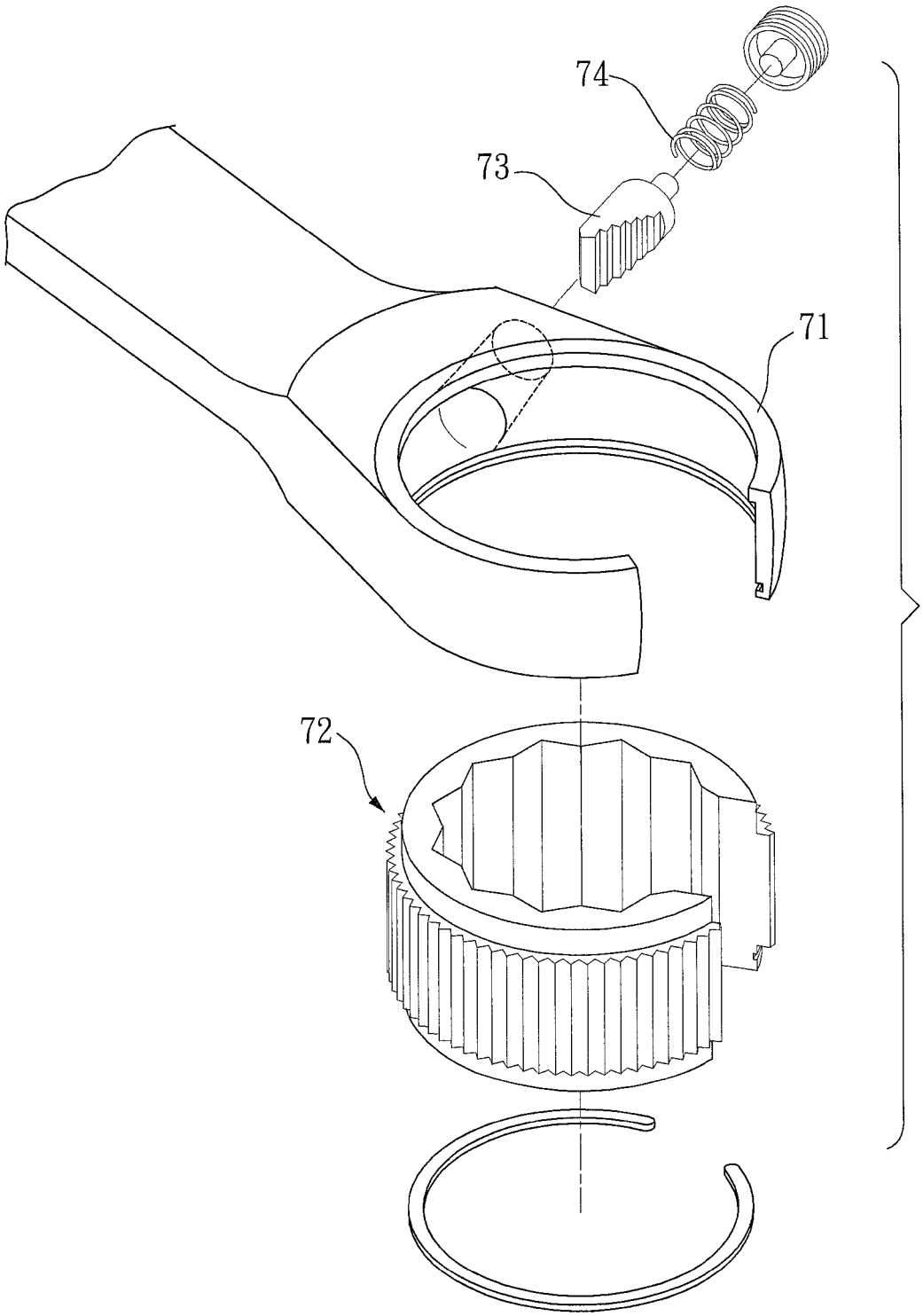
FIG. 8 PRIOR ART
FIG. 8 is an exploded view of another conventional ratchet wrench.

Of course, there are many other embodiments with minor modifications. With reference to FIG. 6 for a second preferred embodiment of the present invention, the protrusion 212 of the moving jaw 2 is an arc portion 213, such that when the moving jaw 2 is turned pivotally, the moving jaw 2 will not be latched to the bottom edge 132 of the containing space 131, but it can be turned to a greater angle in the containing space 131. Therefore, users can turn the moving jaw 2 outward, and the width of the opening 3 between the front end 143 of the fixed jaw 14 and the moving end 22 of the moving jaw 2 can be greater than the external diameter of the ratchet 4 for facilitating the ratchet 4 to be removed or separated from the two jaws for a convenient replacement or repair.

The present invention improves over the prior art and complies with patent application requirements, and thus is duly filed for the patent application. While the invention has been described by device of specific embodiments, numerous modifications and variations could be made thereto by those generally skilled in the art without departing from the scope and spirit of the invention set forth in the claims.

What is claimed is:

1. A ratchet wrench, comprising:

a rod-shape handle, with a working end having a pivot portion, and a fixed jaw integrally extended from the working end, and the fixed jaw having a front end;

a moving jaw, having a pivoting base pivotally coupled to the pivot portion of the handle by a pivot element, and a clamp having an arc shape between both ends of the clamp and disposed at a position away from a moving end of the pivoting base, and the clamp having a plurality of continuously arranged teeth formed from the moving end, and an opening having a predetermined width and being formed between the front end of the fixed jaw and the moving end of the moving jaw moving end;

a ratchet, installed between the two jaws, and having a working hole formed at the center of the ratchet, a plurality of concave portions formed on a hole wall of the working hole, a plurality of teeth continuously arranged along a circumferential surface and disposed at an external circumference of the ratchet, an opening formed on a side of the ratchet and coupled to the opening between the front end of the fixed jaw and the moving end of the moving jaw, and the total length of plurality of teeth of the moving jaw being greater than the width of the opening of the ratchet;

an elastic element, installed onto the handle, for propping the moving jaw, such that the moving jaw exerts a compression force against the ratchet, and the teeth of the moving jaw are engaged with the teeth of the ratchet;

wherein the handle includes a containing space formed at an internal side of the pivot portion, and provided for installing the pivoting base of the moving jaw, and the containing space includes a bottom edge, and the pivoting base includes a recession, a stop edge formed on a side of the recession of the pivoting base, and the recession includes a protruding base, and the elastic element has a sheath hole and installed onto the protruding base, and both ends of the elastic element are first and second abutting ends, and the first abutting end abuts against the stop edge, and the second abutting end abuts the bottom edge.

2. The ratchet wrench of claim 1, wherein the moving jaw has a distance from the center point of the pivot element to the moving end greater than the distance of the fixed jaw from the center point of the pivot element to the front end.

3. The ratchet wrench of claim 1, wherein the plurality of teeth at the external circumference of the ratchet has a tooth pitch smaller than the tooth pitch of the plurality of teeth of the moving jaw.

4. The ratchet wrench of claim 1, wherein the ratchet external circumference has a radius of curvature smaller than the radius of curvature of the clamp of the moving jaw.

5. The ratchet wrench of claim 1, wherein the pivoting base of the moving jaw has a protrusion blocked by the bottom edge of the containing space of the handle.

6. The ratchet wrench of claim 1, wherein the fixed jaw has a stop wall extended separately from both lateral surfaces of the fixed jaw, and the two stop walls include a groove formed therebetween, and a stop ring is installed around an external circumference of the ratchet, such that the stop ring can be mounted onto the stop wall, and the teeth of the ratchet are contained in the groove.

* * * * *